United States Patent [19]

Foresman

[11] Patent Number: 4,732,488

[45] Date of Patent: Mar. 22, 1988

[54] APPARATUS TO UNIFORMLY FEED PLUG FLOW MATERIAL FROM STORAGE TO LINE OPERATION

[75] Inventor: James D. Foresman, Hughesville, Pa.

[73] Assignee: Sprout-Bauer, Inc., Muncy, Pa.

[21] Appl. No.: 872,943

[22] Filed: Jun. 11, 1986

[51] Int. Cl.[4] ..... B01F 15/02

[52] U.S. Cl. ..... 366/155; 366/186; 366/195; 366/300

[58] Field of Search ..... 366/155, 186, 195, 196, 366/297, 298, 300, 194, 156

[56] References Cited

U.S. PATENT DOCUMENTS

| | | | |
|---|---|---|---|
| 3,879,150 | 4/1975 | Brown et al. | 366/300 |
| 3,929,416 | 12/1975 | Tanaka et al. | 366/195 |
| 4,037,826 | 7/1977 | Huslander et al. | 366/156 |
| 4,149,100 | 4/1979 | Moller | 366/150 |
| 4,256,407 | 3/1981 | Seiderman | 366/300 |
| 4,443,109 | 4/1984 | Watts | 366/134 |
| 4,597,672 | 7/1986 | Neir et al. | 366/186 |

*Primary Examiner*—Harvey C. Hornsby
*Assistant Examiner*—Corinne M. Reinckens
*Attorney, Agent, or Firm*—William W. Habelt

[57] ABSTRACT

An inlet device comprises an inlet chute, an inlet hopper pan and two agitator blades in counter rotation above the flights of a plug screw feeder. The blades are housed in a pan which sealingly connects to a cast plug screw liner which is a U-shaped trough for the plug screw. The agitator blades are driven by shafts supported in pillow block bearings fastened to a main housing. The main housing holds a gear train driven by a right angle gearmotor. The gearmotor is also mounted on the main housing and drives abutting geats in counter rotation above the flights of the plug screw. A storage bin, reservoir, worm conveyor or some type of pulsating feeding arrangement feeds directly into the instant inlet device. The inlet device then feeds into line operations, e.g., a pulp refiner line operation.

2 Claims, 3 Drawing Figures

APPARATUS TO UNIFORMLY FEED PLUG FLOW MATERIAL FROM STORAGE TO LINE OPERATION

BACKGROUND OF THE INVENTION

1. Field of the Invention.

The present invention relates to the transfer of material from a storage location to a line operation and, more particularly, to the movement of wood chips from chip bins into the refiner line operation for making pulp.

2. Brief Description of the Prior Art.

A fundamental problem in the handling of plug flow material arises from the plug flow material's tendency to bridge and wedge and form unrelieved areas of flow so that continued flow is prevented.

In the refining of wood chips into a pulp to make paper, the quality of the pulp can be improved when the refiner operation in the paper mill is held stable, i.e., there are no flow interruptions in the lines supplying wood chips to the pulping machines or refiners.

Screw feeders are often employed for supplying the feed materials. A basic problem associated with all plug screw feeders is a tendency of chips to compact against the discharge side of the inlet hopper causing reduced bin flow, inefficient plug screw flight filling and, in some cases, complete bridging in the chip bin discharge. This bridging problem becomes more pronounced when sodium sulphite and steam are added to the chip bin because of chip swelling and softening which adversely affects chip flow characteristics. Chip flow characteristics are also reduced when chip quality, that is particle size and shape, is not closely maintained.

An axial flow pattern of chips will show compaction in the discharge area of an inlet screw feeder. Compaction is more pronounced in plug screw feeders due to a compression zone being located at the discharge side of the inlet area. As a result, there is no relieved area for the chips to flow into. Plug screw feeders with a single agitator sweep usually experience wood chip rotation above the plug screw which results in an uneven drawdown from the storage bin. The graph of screw feeding verses feed screw RPM is usually non-linear when a single agitator is used. Screw feeders heretofore have used single agitators, but these screw feeders usually had to use conventional vibrating transition pieces. These pieces are normally installed between the storage bin discharge chute and the screw feeder. However, the inlet device of the present invention does not need such a piece.

U.S. Pat. No. 4,518,262 shows a worm conveyor discharge being swept by a single agitator at the inlet end of a worm conveyor discharge. The shaft of the agitator perpendicularly crosses the axis of rotation of the screw in the worm conveyor so that material is constantly radially accelerated into the inlet end of the worm conveyor against the full end face of the screw flight.

U.S. Pat. No. 4,443,109 has a single agitator perpendicularly above the axis of rotation of a screw conveyor. The agitator vanes sweep a conical vessel above the flights of the screw conveyors but are vertically removed therefrom by the length of a cylindrical chute between the vessel and a housing for the screw conveyor.

Refiner operations not having a constant through-put rate are kept at an undesirably low level of refinement in converting wood chips into quality pulp.

In view of the above described disadvantages of the flow pattern of screw feeders heretofore know, it is the object of the present invention to provide a machine of this kind which is not subject to surges in material feed flow.

SUMMARY OF THE INVENTION

The conveyor system of the present invention includes two agitators sweeping directly over the top of plug screw inlet flights as a means to pass wood chips in liquid suspension from a chip bin into a plug screw. The plug screw then feeds uniformly to a refiner line without problems of flow interruptions, bridging, or compaction of the chips. Twin agitators located within an inlet housing sweep fills a plug screw inlet hopper pan with a leveling effect which stabilizes the rate of plug screw feed going into the refiner line operation.

An inlet chute acts as a chip reservoir and provides a buffer between the plug screw and any storage flow interruptions. Semi-circular inlet pans house each agitator and have bottoms approximately level with the top of the flights of the plug screw. The increased uniformity of the plug screw feed results in a more stabilized refiner line operation and, therefore, improves the pulp quality without any other changes in the refiner operation. The performance of the present inlet device controls the stability of the flow of wood chips and pulp within the refining zone between the surfaces of the refiner plates or discs. This flow is critical to the ability of the refiner apparatus to form quality pulp fibrils, i.e., curly, twisted filaments or stands without forming excessive amounts of shives, short fibers or small wood particles.

The twin agitator plug screw inlet eliminates bridging problems which can occur between the discharge of a chip bin and the inlet of the plug screw by elimination of chip compaction in this area.

The leveling effect of the agitator on the plug screw inlet flights produces better flight filling and a more uniform feed. This increased uniformity of plug screw feed results in a more stabilized refiner line operation.

The twin agitator plug screw feeder can be fed directly from a screw conveyor or other type of pulsating feeding arrangement without adversely affecting the stability of the refiner line.

The storage bin discharge opening can be opened up or increased due to the added width of the inlet pans. An enlarged bin discharge reduces bin bridging in bin cone section.

BRIEF DESCRIPTION OF THE DRAWINGS

The present invention is further described by the accompanying drawings in which.

DETAILED DESCRIPTION

Figure 1:
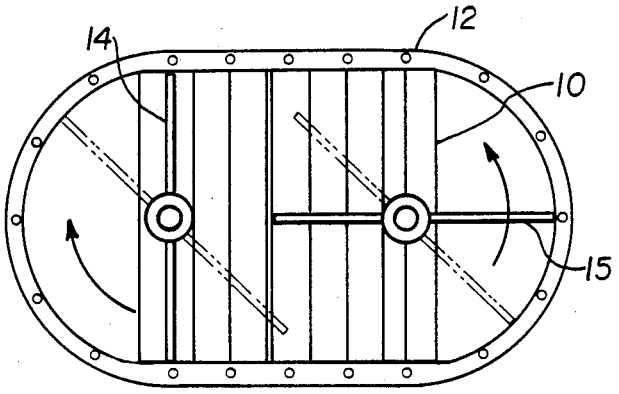
FIG. 1 is a plan view of the inlet chute and the inlet hopper pan showing the center point in each semi-circular inlet hopper pan with two blade positions in each semi-circular section of each pan to show the sequence of rotation of each agitator.
Figure 2:
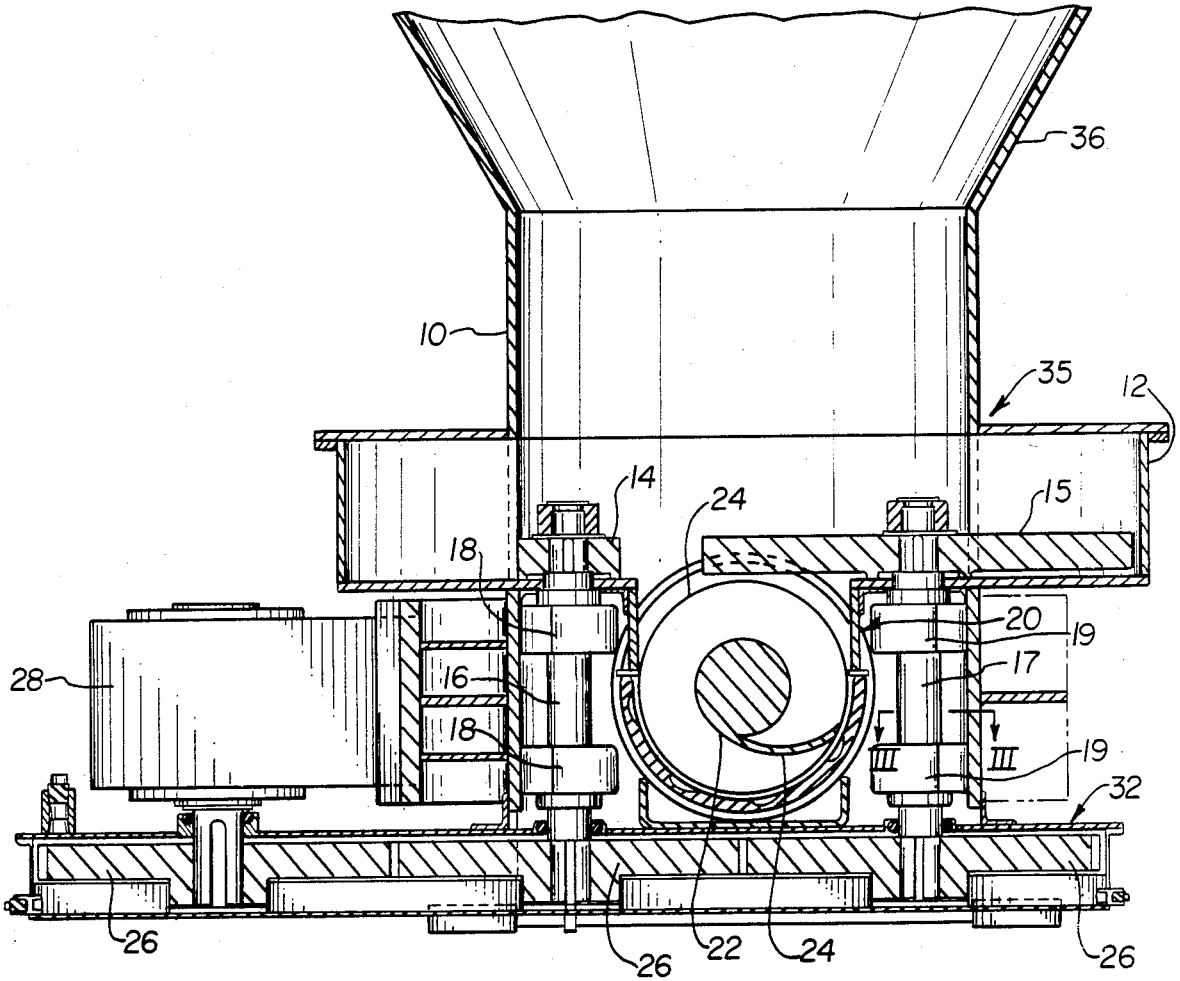
FIG. 2 is an elevational cross-sectional view from the cone section of the bin through the gear train taken through the axis of rotation of the shafts. The shafts, pillow blocks, and drive motor, however, are schematically illustrated in side view.
Figure 3:
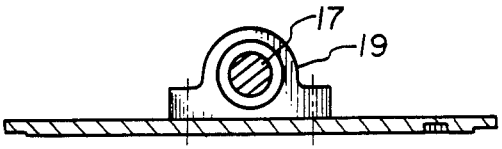
FIG. 3 is cross-sectional view of a pillow block taken through line I—I in FIG. 3.

With reference to the drawings, a main housing 32 supports a standard plug screw cast inlet liner 20. A plug screw 22 is housed in liner 20 and is powered by a gear motor (not shown). Two rotating vertical shafts 16 and 17 are mounted in pillow block bearings 18. These shafts 16 and 17 are positioned on centerlines perpendicular to the screw axis of plug screw 22. The centerlines of the shafts 16 and 17 are on each side of the plug screw 22 and their centerlines perpendicular to the screw axis share the same vertical plane on opposite sides of the plug screw 22. Attached to the top of each shaft 16 and 17 are agitator blades 14 and 15 which sweep directly over the top of the plug screw inlet flights 24. The vertical shafts 16 and 17 are driven by a set of three gears 26 positioned in the bottom of the main housing 32. Each vertical shaft 16 and 17 has a gear 26 attached to its bottom end and these gears 26 are driven directly from a gear 26 attached to a right angle gear motor 28 which powers the agitator blades 14 and 15. The gears 26 are in a planar train and each gear in the gear train is in counter rotation to each gear adjacent to it, therefore, since the blades 14 and 15 are driven by planar adjacently abutting gears 26 in the gear train, the blades 14 and 15 eliminates the tendency of the material rotation in the inlet chute 10 which causes uneven drawdown from the storage bin cone section 36. Also as the blades 14 and 15 sweep directly above the plug screw inlet flights 24, this sweep action of the agitator blades 14 and 15 keeps the inlet flights 24 uniformly filled by effectively leveling off the feed material at the top of the inlet flights 24. The twin arrangement of the counter rotating agitator blades promotes a sweeping action directly above the screw flights 24 where it is the most effective in leveling action and covers the maximum area over the screw 22 inlet. This arrangement of two agitator blased 14 and 15 instead of a single agitator blade also enables the use of shorter blades 14 and 15 which allows higher rpm and thinner agitator blades 14 and 15 due to lower torque requirements.

The inlet chute 10 bolts directly to the top of the inlet hopper pan 12. The conventional vibrating transition piece normally bolted to a storage bin discharge system is not needed nor is it of any value to the present invention. The inlet chute 10 is attached to the storage bin discharge 35 and acts as a reservoir to provide a buffer zone between the plug screw 22 and any flow interruptions from the storage bin 36.

The inlet chute 10, inlet hopper pan 12 and twin agitator blades 14 and 15 combination eliminates bridging problems in the cone section 36 of the storage bin discharge by preventing any material compaction in the discharge area.

The twin agitator plug screw inlet device 34 can also be fed directly from a screw conveyor or other type of pulsating feeding arrangement without adversely affecting the stability of the line operation flow.

Furthermore, the discharge opening 36 from a storage bin can be opened up or increased due to the increased width of the inlets hopper pans. An enlarged bin discharge reduces storage bin bridging in the bin cone section.

Pillow block bearings 18 support the rotating shafts 16 and 17 and in turn the agitator blades 14 and 15 attached to the shafts 16 and 17. The gear 26 train in turn is supported by bearings (not numbered) in the main housing 32. The main housing 32 also supports the right angle gear of the right angle gearmotor 28. The motor itself is bolted to a bracket (not numbered) on the side of the main housing 32.

As feed material descends by gravity through the cone section 36 of the storage bin into the inlet chute 10 and then into the inlet hopper pan 12, the agitator blades 14 and 15 are constantly relieving the space directly above all inlet flights on the plug screw feeder. The axial flow pattern existing between the plug screw cast inlet liner 20 and the flights 24 has been relieved by sweeping the space above the compression zone located above the discharge side of the plug screw feeder. By eliminating feed material compaction above this compression zone at the discharge side of the inlet device, the bridging problem of the plug flow material can be stopped.

The size of the inlet chute 10 can be opened or increased to match the added width of the inlet hopper pans 12. An enlarged bin discharge will reduce the bridging of the plug flow material as the distance to form a bridge is increased to the width of the hopper pans 12.

It will be appreciated that the above descriabed apparatus can be used to feed material from a screw or worm conveyor or from a pulsating feeder as well as from a storage, and the use herein of the term "material storage source" encompasses storage bins, screw and worm conveyors, pulsating feeders and like means for storing, conveying or feeding materials.

Although the invention has been described with a certain degree of particularity, it is to be understood that the present invention has been made only as an example and that the scope of the invention is defined by what is hereafter claimed.

What is claimed is:

1. An apparatus for feeding a plug flow material from the outlet of a material storage vessel into a flow line passing beneath the material storage vessel, comprising:

a. plug screw means disposed in the flow line for moving material therethrough, said plug screw means having a screw having an axis disposed parallel to the flow line and an inlet opening to receive material to the screw, the screw being adapted for rotation about its axis whereby the received material is passed through the flow line;

b. an inlet hopper pan disposed superadjacent the inlet opening to said plug screw means, said hopper pan having a outlet opening to the inlet opening to said plug screw means and an inlet opening for receiving material;

c. an inlet chute interconnecting the material storage vessel in flow communication with said hopper pan thereby establishing a material flow passageway therebetween, said inlet chute having an inlet opening adapted to mate with the outlet of the material storage vessel for receiving said plug flow material therefrom and an outlet opening adapted to mate with the inlet opening to said hopper pan for passing the plug flow material thereto; and d. agitator means disposed in said hopper pan superadjacent the outlet from said hopper pan for sweeping the plug flow material therefrom through the inlet opening to the screw of said plug screw means, said agitator means mounted to rotating shaft means perpendicularly disposed to the axis of the screw of said plug screw means whereby the agitator means mounted to the shaft means is rotated about an axis of rotation perpendicular to the axis of the screw of said plug screw means.

and wherein said agitator means mounted to said rotating shaft means comprises a pair of agitator blades, one mounted to a first rotating shaft means and one mounted to a second rotating shaft means, said first and second rotating shaft means disposed on opposite sides of said plug screw means with their axis of rotation in a common vertical plane, the common vertical plane being disposed perpendicular to the axis of the screw of said plug screw means.

2. An apparatus as recited in claim 17 wherein said first rotating shaft means is rotated in a clockwise direction and said second rotating shaft means is rotated in a counter-clockwise direction whereby said pair of agitator blades are rotated in counter rotation with respect to each other.

* * * * *

UNITED STATES PATENT AND TRADEMARK OFFICE

CERTIFICATE OF CORRECTION

PATENT NO. : 4,732,488

DATED : March 22, 1988

INVENTOR(S) : James D. Foresman

It is certified that error appears in the above—identified patent and that said Letters Patent is hereby corrected as shown below:

Claim 1, column 5, line 2, the "." following "means" should be deleted.

Claim 2, column 6, line 3, "claim 17" should be --claim 1--.

Signed and Sealed this

Fifth Day of September, 1989

*Attest:*

*Attesting Officer*

DONALD J. QUIGG

*Commissioner of Patents and Trademarks*